US007988079B2

(12) United States Patent
Chen et al.

(10) Patent No.: US 7,988,079 B2
(45) Date of Patent: Aug. 2, 2011

(54) NEW-TYPE DUAL-PASSAGE PAPER FEEDING SAFETY STRUCTURE FOR SHREDDERS

(75) Inventors: Hsin-Hsiung Chen, Shanghai (CN); Guanglong Chen, Shanghai (CN)

(73) Assignee: Aurora Office Equipment Co., Ltd., Shanghai (CN)

( * ) Notice: Subject to any disclaimer, the term of this patent is extended or adjusted under 35 U.S.C. 154(b) by 0 days.

(21) Appl. No.: 12/689,142

(22) Filed: Jan. 18, 2010

(65) Prior Publication Data

US 2010/0187342 A1 Jul. 29, 2010

(30) Foreign Application Priority Data

Jan. 23, 2009 (CN) ..... 2009 2 0067418 U
Sep. 22, 2009 (CN) ..... 2009 1 0196043

(51) Int. Cl.
*B02C 25/00* (2006.01)

(52) U.S. Cl. ..... 241/36; 241/37.5

(58) Field of Classification Search ..... 241/36, 241/37.5, 100, 236, 222, 224
See application file for complete search history.

(56) References Cited

U.S. PATENT DOCUMENTS 7,757,985 B2 * 7/2010 Chen ..... 241/37.5

* cited by examiner

*Primary Examiner* — Mark Rosenbaum
(74) *Attorney, Agent, or Firm* — Wang, Hartmann, Gibbs & Cauley; John O'Rourke

(57) ABSTRACT

The present invention relates to a new-type dual-passage paper feeding safety structure for shredders comprising a shredder upper lid, a dual-passage paper feeding safety cover plate and a touch safety switch, touch components are arranged on the dual-passage paper feeding safety cover plate, the shredder upper lid has a paper inlet corresponding to the dual-passage paper feeding safety cover plate and above the set of paper shredding blade shafts of the shredders, the dual-passage paper feeding safety cover plate is arranged in the paper inlet, the middle parts of two ends of the dual-passage paper feeding safety cover plate is connected rotatably with the shredder upper lid, the touch safety switch is fixed inside the shredder upper lid and cooperated with the touch components so that the touch components would touch the touch safety switch when the dual-passage paper feeding safety cover plate is rotated to open and work, more preferably, the middle parts of two ends of the dual-passage paper feeding safety cover plate are pivoted with the shredder upper lid, the touch components are touch cams, a working and stand-by limiting structure is also included, and the dual-passage paper feeding safety cover plate further has a disc feeding passage at its middle part, therefore the new-type dual-passage paper feeding safety structure for shredders of the present invention is designed dexterously and convenient to use, and has a high safety and economy.

13 Claims, 7 Drawing Sheets

NEW-TYPE DUAL-PASSAGE PAPER FEEDING SAFETY STRUCTURE FOR SHREDDERS

CROSS-REFERENCE TO RELATED APPLICATIONS

This application claims priority benefits of Chinese Patent Application Number 200920067418.9, filed Jan. 23, 2009, and Chinese Patent Application Number 200910196043.0, filed Sep. 22, 2009

TECHNOLOGY FIELD

The present invention relates to the field of safety operation devices for shredders, especially to the field of safety protection devices for shredders, in particular to a new-type dual-passage paper feeding safety structure for shredders.

BACKGROUND TECHNOLOGY

At present, the paper inlets of shredders used commonly have two structural forms: one is an open type structure for feeding paper vertically, that is, users can insert paper directly into the paper inlet to shred paper; the other one is a semi-shielded type structure with a simple stop device, so that if users insert a lot of paper into the paper inlet, the paper would push the stop device to switch off the power supply, to protect the users. However, the latter form would retain an aperture of the paper inlet for feeding a small amount of paper, causing hidden dangers to exist, at the same time the device added decreases the width of the paper inlet, resulting in unsmooth paper feeding.

In order to solve the above existing problems, it is very necessary to further improve the existing paper inlets for shredders, so as to improve the safety of shredders to make users shred paper more conveniently, under the condition of guaranteeing normal paper shredding.

DISCLOSURE OF THE INVENTION

Aspects of the present invention generally pertain to a new-type dual-passage paper feeding safety structure for shredders, which is designed dexterously and convenient to use, and has a, high safety and economy.

In order to realize the above aims, the new-type dual-passage paper feeding safety structure for shredders of the present invention has the following structures:

The new-type dual-passage paper feeding safety structure for shredders comprises a shredder upper lid, the new-type dual-passage paper feeding safety structure for shredders further comprises a dual-passage paper feeding safety cover plate and a touch safety switch, touch components are arranged on the dual-passage paper feeding safety cover plate, the shredder upper lid has a paper inlet corresponding to the dual-passage paper feeding safety cover plate and above the set of paper shredding blade shafts of the shredders, the dual-passage paper feeding safety cover plate is arranged in the paper inlet, the middle parts of two ends of the dual-passage paper feeding safety cover plate is connected rotatably with the shredder upper lid, the touch safety switch is fixed inside the shredder upper lid and cooperated with the touch components so that the touch components would touch the touch safety switch when the dual-passage paper feeding safety cover plate is rotated to open and work.

In an aspect, the middle parts of two ends of the dual-passage paper feeding safety cover plate are pivoted with the shredder upper lid.

In a further aspect, the dual-passage paper feeding safety cover plate further comprises a first side plate and a second side plate, the first side plate and the second side plate are fixed respectively at the middle parts of two ends of the lower surface of the dual-passage paper feeding safety cover plate, and pivoted respectively with the shredder upper lid, and the touch components are located on the first side plate/the second side plate.

In yet another aspect, a first shaft seat and a second shaft seat are arranged inside the shredder upper lid and positioned at two sides inside the paper inlet, and correspond to the first side plate and the second side plate respectively, two rotary shafts are arranged on the first shaft seat and the second shaft seat respectively and face to face, two shaft holes are arranged on the first side plate and the second side plate respectively, and the two rotary shafts are located in the two shaft holes respectively.

In yet another aspect, the touch safety switch is fixed on the first shaft seat/the second shaft seat.

In yet another aspect, an arc-shaped cam is arranged on the first side plate/the second side plate and takes the shaft hole as its center, and two of the touch components are fixed at two ends of the arc-shaped cam.

In yet another aspect, a convex rib is arranged laterally on the outer arc surface/the inner arc surface of the arc-shaped cam, the first shaft seat/the second shaft seat has a semi-circular annular groove, two working slots and one stand-by slot are arranged laterally on the lower surface/the upper surface of the semi-circular annular groove, the two working slots are arranged symmetrically relative to the stand-by slot, the arc-shaped cam is positioned in the semi-circular annular groove, and the convex rib is located in the stand-by slot.

In an aspect, at least one pair of paper guiding ribs is arranged laterally on the lower surface of the dual-passage paper feeding safety cover plate, two paper guiding ribs of the pair of paper guiding ribs are arranged to incline downwards and inwards from the front and back sides of the lower surface respectively till intersect.

In an aspect, two indicating press areas are arranged respectively on the middle parts of the front and back sides of the upper surface of the dual-passage paper feeding safety cover plate.

In an aspect, the cross-section of the paper inlet is semi-circular, and the touch components are touch cams.

In an aspect, the new-type dual-passage paper feeding safety structure for shredders further comprises a paper thickness detecting device arranged in the paper inlet.

In an aspect, the dual-passage paper feeding safety cover plate further has a disc feeding passage at its middle part and above the paper shredding blade shafts.

In an aspect, the shredder upper lid further has a card feeding passage, the shredder further comprises a set of card shredding blade shafts, and the card feeding passage is located above the card shredding blade shafts.

The beneficial effects of the present invention are that:

1. The invention adopts the shredder dual-passage paper feeding safety cover plate, the middle parts of two ends of which are pivoted with the shredder upper lid, thus the shredder dual-passage paper feeding safety cover plate can rotate forwards or backwards around the shafts, and the touch cams are cooperated with the touch safety device, so the present invention has a simple structure, and is convenient to use for paper can be fed at two directions;

2. The present invention utilizes artfully the shaft supports and the touch safety switch to cooperate to achieve the open and closure of the dual-passage paper feeding safety cover plate, when the shredder does not work, the dual-passage paper feeding safety cover plate covers the paper inlet and the shredder is power off, when the paper inlet opens, the power supply is connected, when the abnormality occurs, the power supply would be switched off timely, so as to prevent human bodies and accessories with them from entering into the paper inlet, thus the present invention has the high protection function to guarantee the personal safety and the safety of child's misuse, therefore the present invention is very safe;

3. Two elastic convex ribs are designed on each of the two cams on two ends of the dual-passage paper feeding safety cover plate, and cooperated with the stand-by slot and the working slots arranged symmetrically on each of the shaft seats, thus the dual-passage paper feeding safety cover plate can be opened and closed accurately at two directions, so the present invention is convenient to use.

4. The paper thickness detecting device is arranged in the paper inlet of the present invention, and connected with the shredder control circuit when installed, so that the circuit can be controlled to be switched on or off according to the number of inserted paper detected to achieve the protection;

5. The present invention has the disc feeding passage at the middle part of the dual-passage paper feeding safety cover plate and above the paper shredding blade shafts, then, when the dual-passage paper feeding safety cover plate is not opened, discs or cards can be shredded through the disc feeding passage, when the dual-passage paper feeding safety cover plate is opened, for the disc feeding passage is not above the paper shredding blade shafts and shielded by the inner wall of the paper inlet, discs or cards can not be shredded through the disc feeding passage, however paper can be shredded through the paper feeding passage opened;

6. The shredder upper lid of the present invention further has a card feeding passage above the set of card shredding blade shafts of the shredder, which guarantees that discs and cards can be inserted directly to be shredded when the dual-passage paper feeding safety cover plate is opened or closed.

PREFERRED EMBODIMENTS OF THE INVENTION

Figure 1:
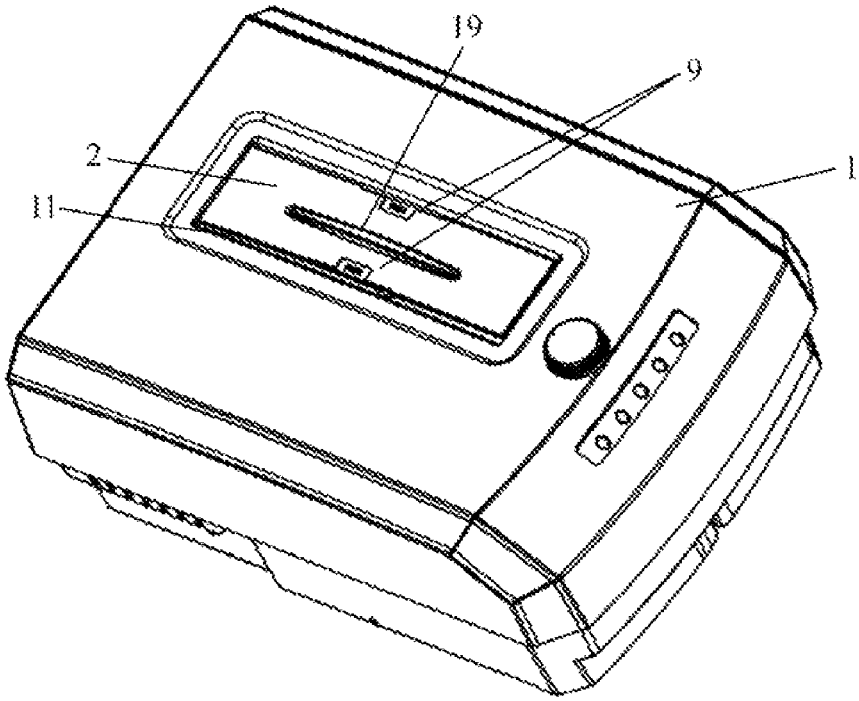
FIG. 1 is a stereogram of one embodiment of the present invention.
Figure 2A:
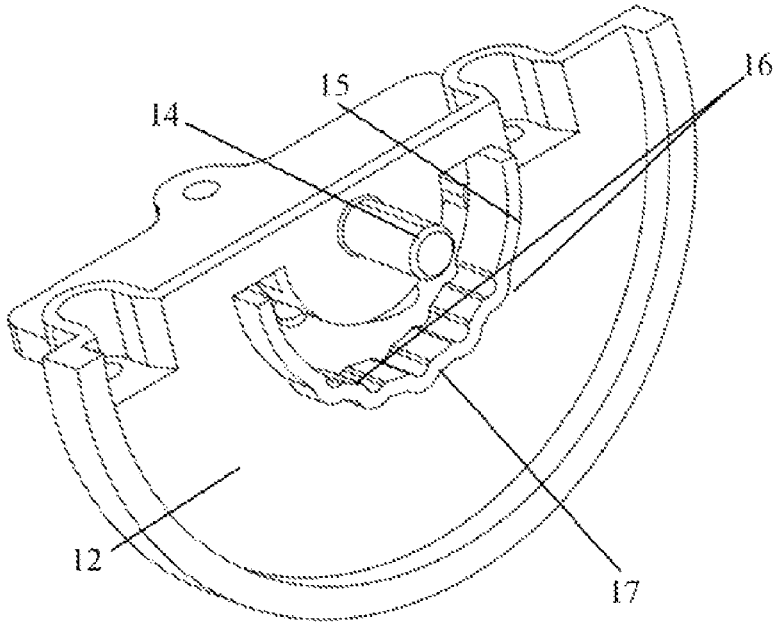
FIG. 2*a* is one stereogram of the first shaft seat of the embodiment shown in FIG. 1.
Figure 2B:
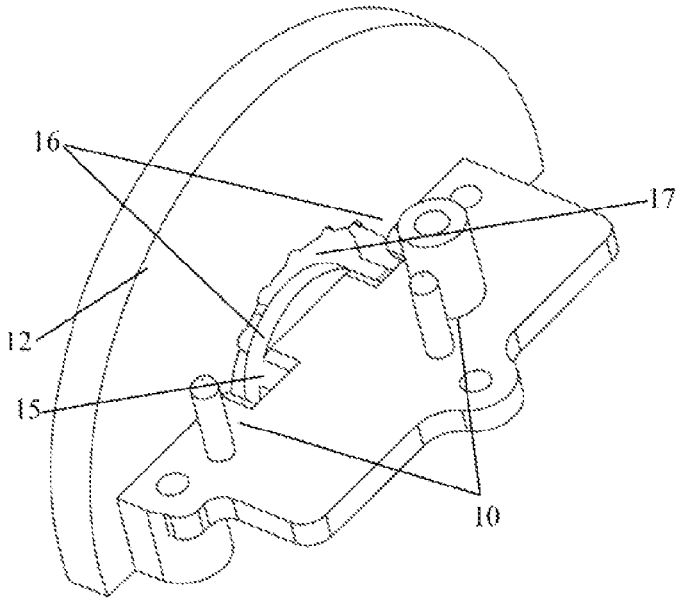
FIG. 2*b* is another stereogram of the first shaft seat of the embodiment shown in FIG. 1.
Figure 3A:
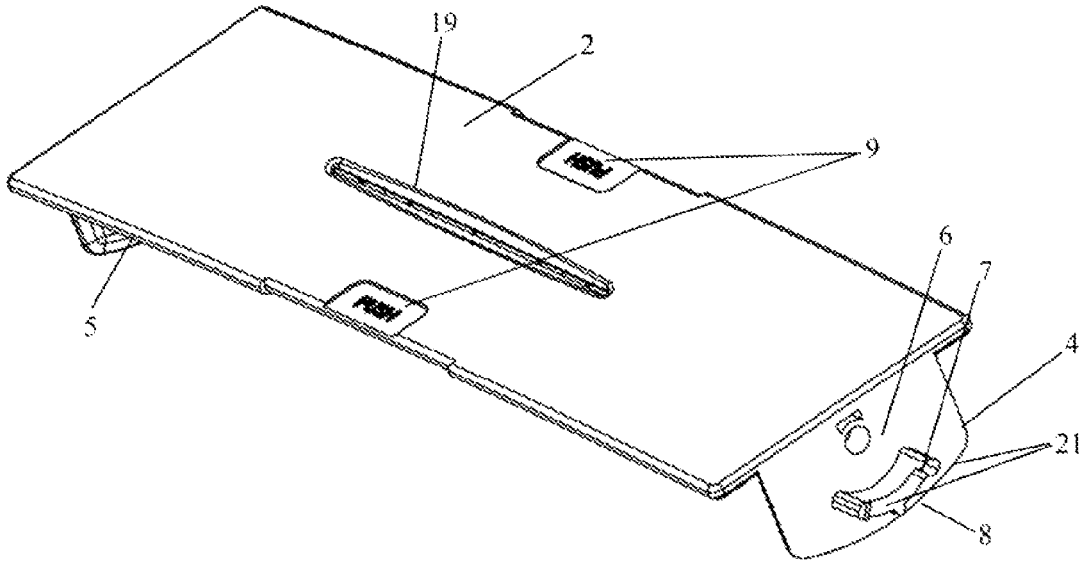
FIG. 3*a* is one stereogram of the dual-passage paper feeding safety cover plate of the embodiment shown in FIG. 1.
Figure 3B:
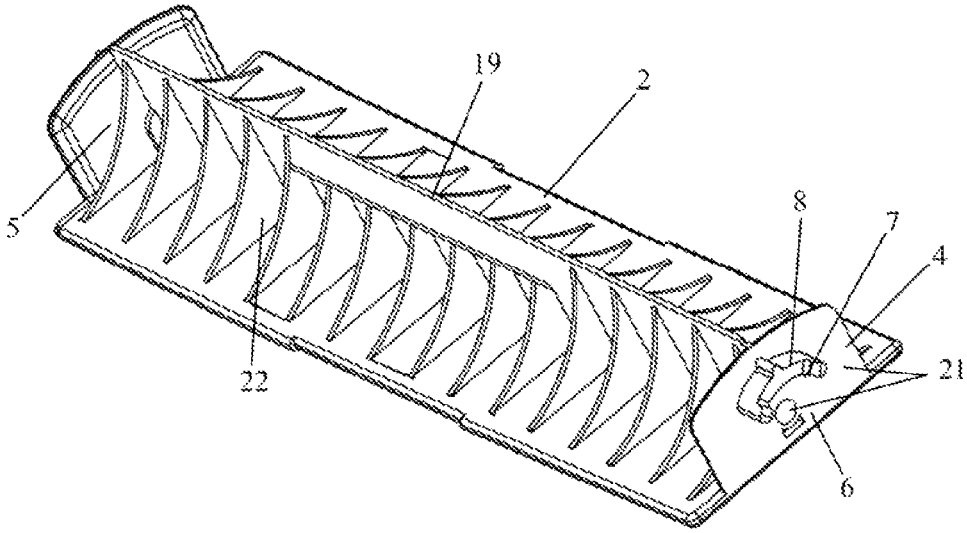
FIG. 3*b* is another stereogram of the dual-passage paper feeding safety cover plate of the embodiment shown in FIG. 1.

In order to understand the technical content of the present invention more clearly, the present invention would be exemplified further by reference to the following embodiments.

Please refer to FIG. 1~9, the new-type dual-passage paper feeding safety structure for shredders of the present invention comprises a shredder upper lid 1, the new-type dual-passage paper feeding safety structure for shredders further comprises a dual-passage paper feeding safety cover plate 2 and a touch safety switch 3, touch components 21 are arranged on the dual-passage paper feeding safety cover plate 2, the shredder upper lid 1 has a paper inlet 11 corresponding to the dual-passage paper feeding safety cover plate 2 and above the set of paper shredding blade shafts of the shredders, the dual-passage paper feeding safety cover plate 2 is arranged in the paper inlet 11, the middle parts of two ends of the dual-passage paper feeding safety cover plate 2 is connected rotatably with the shredder upper lid 1, the touch safety switch 3 is fixed inside the shredder upper lid 1 and cooperated with the touch components 21 so that the touch components 21 would touch the touch safety switch 3 when the dual-passage paper feeding safety cover plate 2 is rotated to open and work. The dual-passage paper feeding safety cover plate 2 is used to cover two paper feeding passages completely, as its two sides rotate in different directions, two paper feeding passage can be exposed respectively. Apparently, the shredder having the dual-passage paper feeding safety cover plate 2 is more safe and reliable.

In an aspect, the middle parts of two ends of the dual-passage paper feeding safety cover plate 2 are pivoted with the shredder upper lid 1.

In a further aspect, the dual-passage paper feeding safety cover plate 2 further comprises a first side plate 4 and a second side plate 5, the first side plate 4 and the second side plate 5 are fixed respectively at the middle parts of two ends of the lower surface of the dual-passage paper feeding safety cover plate 2, and pivoted respectively with the shredder upper lid 1, and the touch components 21 are located on the first side plate 4/the second side plate 5. In the present embodiment of the present invention, the touch components 21 are located on the first side plate 4.

In yet another aspect, a first shaft seat 12 and a second shaft seat 13 are arranged inside the shredder upper lid 1 and positioned at two sides inside the paper inlet 11, and correspond to the first side plate 4 and the second side plate 5 respectively, two rotary shafts 14 are arranged on the first shaft seat 12 and the second shaft seat 13 respectively and face to face, two shaft holes 6 are arranged on the first side plate 4 and the second side plate 5 respectively, and the two rotary shafts 14 are located in the two shaft holes 6 respectively.

In yet another aspect, the touch safety switch 3 is fixed on the first shaft seat 12/the second shaft seat 13. In the present embodiment of the present invention, the touch safety switch 3 is fixed on two plastic columns 10 of the first shaft seat 12.

In yet another aspect, an arc-shaped cam 7 is arranged on the first side plate 4/the second side plate 5 and takes the shaft hole 6 as its center, and two of the touch components 21 are fixed at two ends of the arc-shaped cam 7. In the present embodiment of the present invention, the arc-shaped cam 7 is arranged on the first side plate 4.

In yet another aspect, a convex rib 8 is arranged laterally on the outer arc surface/the inner arc surface of the arc-shaped cam 7, the first shaft seat 12/the second shaft seat 13 has a semi-circular annular groove 15, two working slots 16 and one stand-by slot 17 are arranged laterally on the lower surface/the upper surface of the semi-circular annular groove 15, the two working slots 16 are arranged symmetrically relative to the stand-by slot 17, the arc-shaped cam 7 is positioned in the semi-circular annular groove 15, and the convex rib 8 is located in the stand-by slot 17. In the present embodiment of the present invention, the convex rib 8 is arranged laterally on the outer arc surface of the arc-shaped cam 7; the working slots 16 and the stand-by slot 17 are arranged laterally on the lower surface of the semi-circular annular groove 15. Therefore the convex rib 8 on the arc-shaped cam 7 and the working slots 16 and the stand-by slot 17 in the semi-circular annular groove 15 form the working and stand-by limiting structure of the present invention.

In an aspect, at least one pair of paper guiding ribs 22 is arranged laterally on the lower surface of the dual-passage paper feeding safety cover plate 2, two paper guiding ribs 22 of the pair of paper guiding ribs 22 are arranged to incline downwards and inwards from the front and back sides of the lower surface respectively till intersect. In the present embodiment of the present invention, 16 pairs of paper guiding ribs 22 are arranged laterally on the lower surface of the dual-passage paper feeding safety cover plate 2, to cause the paper inlet 11 (a semi-circular opening) to form two paper feeding passages with the paper guiding ribs 22 when the dual-passage paper feeding safety cover plate 2 is opened at different directions, and paper can be fed into the shredding blades through the two paper feeding passages.

In the present embodiment of the present invention, two indicating press areas 9 are arranged respectively on the middle parts of the front and back sides of the upper surface of the dual-passage paper feeding safety cover plate 2.

In the present embodiment of the present invention, the cross-section of the paper inlet 11 is semi-circular, and the touch components 21 are touch cams.

In the present embodiment of the present invention, the new-type dual-passage paper feeding safety structure for shredders further comprises a paper thickness detecting device (not shown) arranged in the paper inlet 11. When the paper thickness detecting device is installed in the shredder, it can be connected with the shredder control circuit, so that the circuit can be controlled to be switched on or off according to the number of inserted paper detected to achieve the protection. It needs only one paper thickness detecting device (which is optically controlled or contains a touch rod) when installed in the common area of the paper inlet 11, however, it needs two paper thickness detecting devices when installed in the non-common area of the paper inlet 11 to detect respectively the paper inserted into the two paper feeding passages formed by opening the dual-passage paper feeding safety cover plate 2.

In the present embodiment of the present invention, the dual-passage paper feeding safety cover plate 2 further has a disc feeding passage 19 at its middle part and above the paper shredding blade shafts. That is, the disc feeding passage 19 is communicated with the paper inlet 11, and has generally 1.2 mm in width and 150 mm in length, then when the dual-passage paper feeding safety cover plate 2 is not opened, through pressing the power supply switch arranged on the shredder upper lid 1, discs or cards can be shredded through the disc feeding passage 19, when the dual-passage paper feeding safety cover plate 2 is opened, for the disc feeding passage 19 is not above the paper shredding blade shafts due to the rotation of the dual-passage paper feeding safety cover plate 2 and shielded by the inner wall of the paper inlet 11, discs or cards can not be shredded through the disc feeding passage 19, however paper can be shredded through the paper feeding passage opened.

In an aspect, the shredder upper lid 1 further has a card feeding passage, the shredder further comprises a set of card shredding blade shafts, and the card feeding passage is located above the card shredding blade shafts. The card feeding passage has generally 1.2 mm in width and 150 mm in length, and when discs or cards like credit cards are needed to be shredded, it also does not need to open the dual-passage paper feeding safety cover plate 2, and discs or cards can be inserted into the card feeding passage to be shredded through directly pressing the power supply switch arranged on the shredder upper lid 1, and when the dual-passage paper feeding safety cover plate 2 is opened, discs or cards can still be inserted into the card feeding passage to be shredded.

Figure 4:
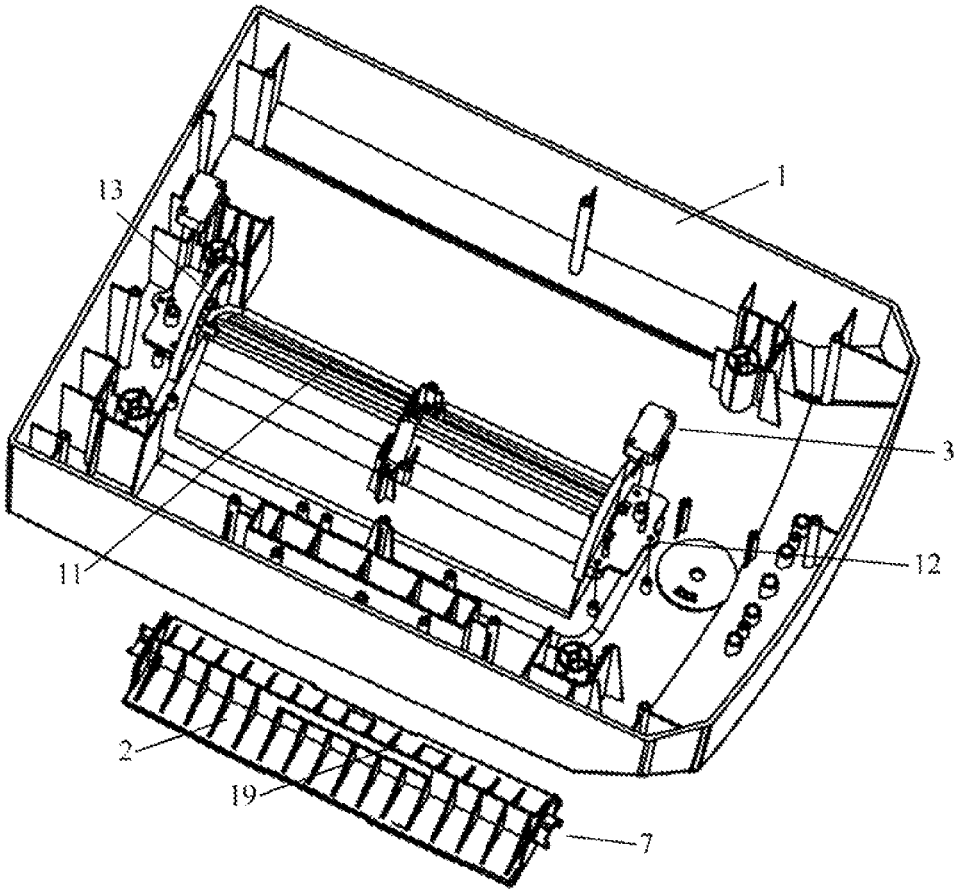
FIG. 4 is an explosive schematic view of the embodiment shown in FIG. 1.
Figure 5:
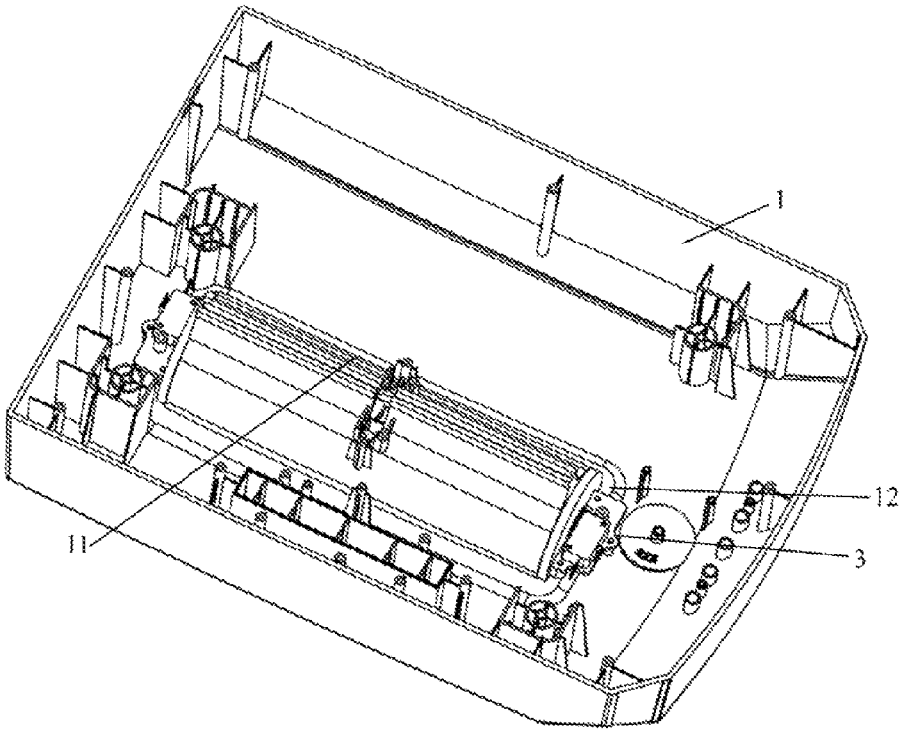
FIG. 5 is another stereogram of the embodiment shown in FIG. 1.
Figure 6:
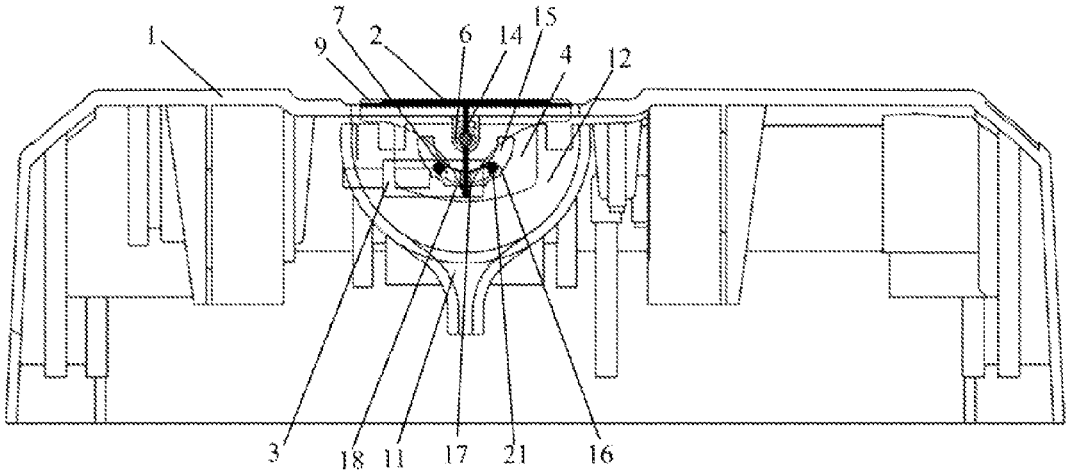
FIG. 6 is a partial schematic view of the cross section of the embodiment shown in FIG. 1.
Figure 7:
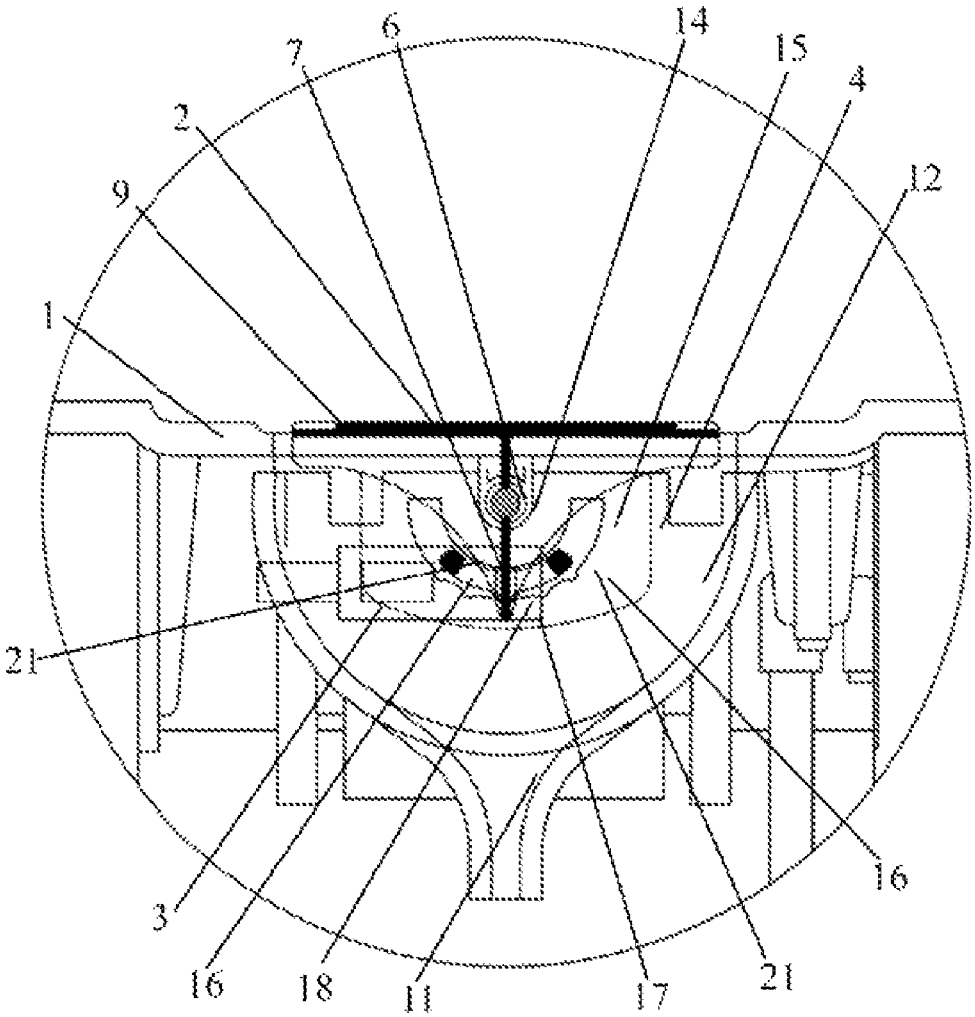
FIG. 7 is a partial enlarged schematic view of the cross section shown in FIG. 6.

Please refer to FIG. 3~6, when the above-mentioned components are assembled, the touch safety switch 3 is fixed on the first shaft seat 12, the rotary shafts 14 of the first shaft seat 12 and the second shaft seat 13 are inserted into the shaft holes 6 of the first side plate 4 and the second side plate 5 respectively, then fixed to and inside the shredder upper lid 1 with screws, the assembling positions are shown in FIG. 4, the assemblage is shown in FIG. 5 and its cross section is shown in FIG. 6.

When the present invention is used, please refer to FIG. 6, when the dual-passage paper feeding safety cover plate 2 is in the closed state, the convex rib 8 is positioned in the stand-by slot 17, at this time the touch cams on the shredder dual-passage paper feeding, safety cover plate 2 do not touch the touching point 18 of the touch safety switch 3, for the touch safety switch 3 controls the power supply of the shredder, at this time the shredder is power off, the paper inlet 11 is in the closed state, therefore the shredder in this state can guarantee personal safety. The partial enlarged figure is shown as FIG. 7. At this time, through pressing the power supply switch arranged on the shredder upper lid 1, discs or cards can be shredded through the disc feeding passage 19.

Figure 8:
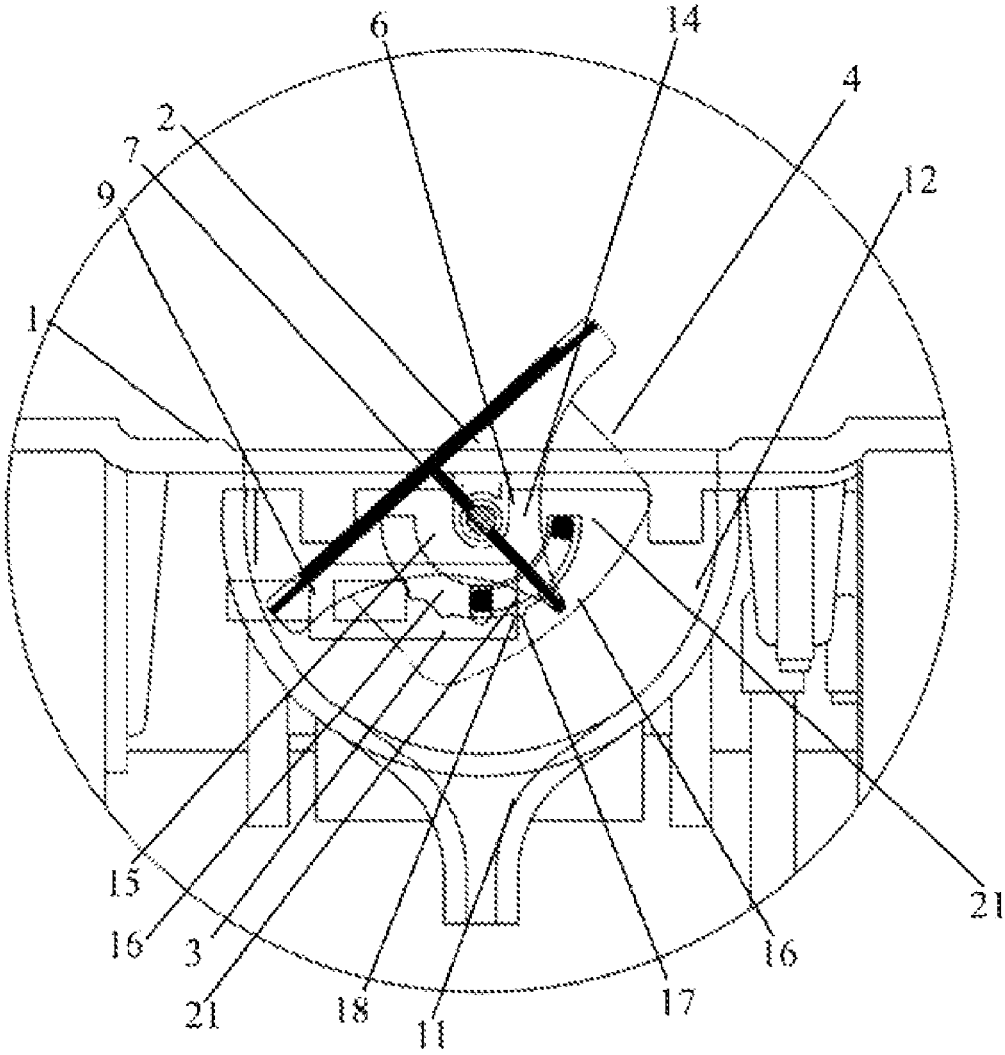
FIG. 8 is a schematic view of the cross section shown in FIG. 7 when the dual-passage paper feeding safety cover plate is pressed at one side.

When paper is needed to be shredded, one of the indicating pressing areas 9 on two sides of the dual-passage paper feeding safety cover plate 2 is pressed, then the guiding ribs 22 of the shredder dual-passage paper feeding safety cover plate 2 and the paper inlet 11 (a semi-circular opening) form a paper feeding passage, at this time the high point at one end of the cam 7 on the dual-passage paper feeding safety cover plate 2 would press the touch safety switch 3, that is, one touch cam presses the touching point 18, so as to turn on the current to make the whole shredder in the power-up state, at this time the convex rib 8 is positioned in one of the working slots 16, and users can shred paper through the paper feeding passage opened by the dual-passage paper feeding safety cover plate 2, as shown in FIG. 8. At this time, discs or cards can be shredded through the card feeding passage simultaneously, but discs or cards can not be shredded through the disc feeding passage 19, for the disc feeding passage 19 is not above the paper shredding blade shafts due to the rotation of the dual-passage paper feeding safety cover plate 2 and shielded by the inner wall of the paper inlet 11.

Figure 9:
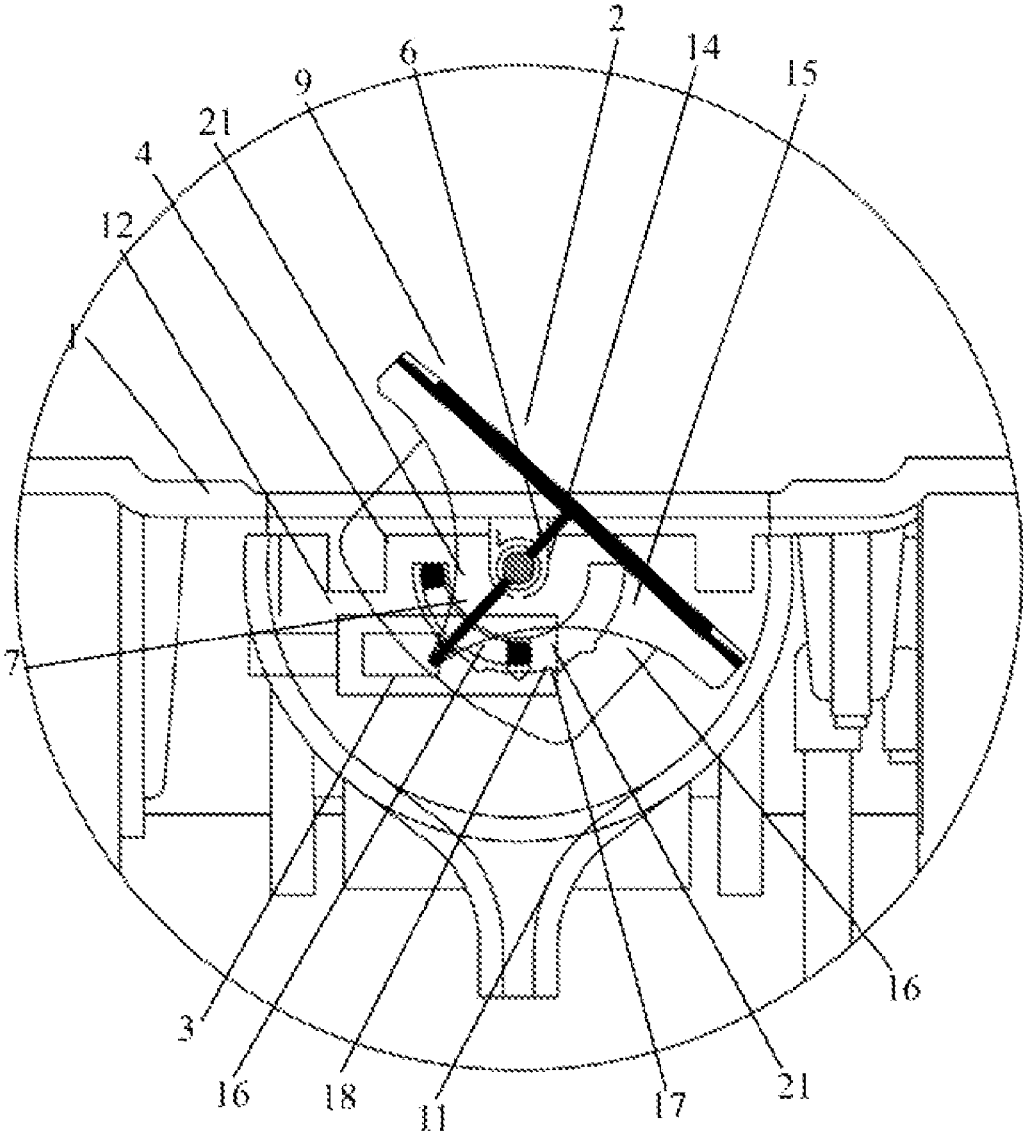
FIG. 9 is a schematic view of the cross section shown in FIG. 7 when the dual-passage paper feeding safety cover plate is pressed at another side.

If the paper feeding passage at the other side is wanted to be used, please refer to FIG. 9, the other one of the indicating pressing areas 9 on the other side of the dual-passage paper feeding safety cover plate 2 is pressed, then the guiding ribs 22 of the shredder dual-passage paper feeding safety cover plate 2 and the paper inlet 11 (a semi-circular opening) form another paper feeding passage, for the same reason, at this time the high point at the other end of the cam 7 on the dual-passage paper feeding safety cover plate 2 would press the touch safety switch 3, that is, another touch cam presses the touching point 18, so as to turn on the current to make the whole shredder in the power-up state, at this time the convex rib 8 is positioned in the other one of the working slots 16, and users can shred paper through the paper feeding passage under the dual-passage paper feeding safety cover plate 2.

In the working state, if articles that are not wanted to be shredded are fed, the dual-passage paper feeding safety cover plate 2 would be rotated to cause the touch cam to act on the touching point 18 of the touch safety switch 3, so as to switch off the touch safety switch 3; during the closure of the dual-passage paper feeding safety cover plate 2, the touch cam would again act on the touching point 18 of the touch safety switch 3, so as to switch off the touch safety switch 3, that is, the cam 7 on the dual-passage paper feeding safety cover plate 2 controls the make and break of the power supply of the shredder by pressing the touching point 18 of the touch safety switch 3 with the touch cams.

To sum up, the new-type dual-passage paper feeding safety structure for shredders of the present invention is designed dexterously and convenient to use, and has a high safety and economy.

While the present invention has been particularly shown and described with references to preferred embodiments thereof, it will be understood by those skilled in the art that various changes in form and details may be made therein without departing from the spirit and scope of the invention as defined by the claims. It is clearly understood therefore that the same is by way of illustration and example only and is not to be taken by way of limitation.

We claim:

1. A new-type dual-passage paper feeding safety structure for shredders, comprising a shredder upper lid, wherein the new-type dual-passage paper feeding safety structure for shredders further comprises a dual-passage paper feeding safety cover plate and a touch safety switch, touch components are arranged on the dual-passage paper feeding safety cover plate, the shredder upper lid has a paper inlet corresponding to the dual-passage paper feeding safety cover plate and above the set of paper shredding blade shafts of the shredders, the dual-passage paper feeding safety cover plate is arranged in the paper inlet, the middle parts of two ends of the dual-passage paper feeding safety cover plate are connected rotatably with the shredder upper lid, the touch safety switch is fixed inside the shredder upper lid and cooperated with the touch components so that the touch components would touch the touch safety switch when the dual-passage paper feeding safety cover plate is rotated to open and work.

2. The new-type dual-passage paper feeding safety structure for shredders according to claim 1, wherein the middle parts of two ends of the dual-passage paper feeding safety cover plate are pivoted with the shredder upper lid.

3. The new-type dual-passage paper feeding safety structure for shredders according to claim 2, wherein the dual-passage paper feeding safety cover plate further comprises a first side plate and a second side plate, the first side plate and the second side plate are fixed respectively at the middle parts of two ends of the lower surface of the dual-passage paper feeding safety cover plate, and pivoted respectively with the shredder upper lid, and the touch components are located on the first side plate/the second side plate.

4. The new-type dual-passage paper feeding safety structure for shredders according to claim 3, wherein a first shaft seat and a second shaft seat are arranged inside the shredder upper lid and positioned at two sides inside the paper inlet, and correspond to the first side plate and the second side plate respectively, two rotary shafts are arranged on the first shaft seat and the second shaft seat respectively and face to face, two shaft holes are arranged on the first side plate and the second side plate respectively, and the two rotary shafts are located in the two shaft holes respectively.

5. The new-type dual-passage paper feeding safety structure for shredders according to claim 4, wherein the touch safety switch is fixed on the first shaft seat/the second shaft seat.

6. The new-type dual-passage paper feeding safety structure for shredders according to claim 4, wherein an arc-shaped cam is arranged on the first side plate/the second side plate and takes the shaft hole as its center, and two of the touch components are fixed at two ends of the arc-shaped cam.

7. The new-type dual-passage paper feeding safety structure for shredders according to claim 6, wherein a convex rib is arranged laterally on the outer arc surface/the inner arc surface of the arc-shaped cam, the first shaft seat/the second shaft seat has a semi-circular annular groove, two working slots and one stand-by slot are arranged laterally on the lower surface/the upper surface of the semi-circular annular groove, the two working slots are arranged symmetrically relative to the stand-by slot, the arc-shaped cam is positioned in the semi-circular annular groove, and the convex rib is located in the stand-by slot.

8. The new-type dual-passage paper feeding safety structure for shredders according to claim 1, wherein at least one pair of paper guiding ribs is arranged laterally on the lower surface of the dual-passage paper feeding safety cover plate, two paper guiding ribs of the pair of paper guiding ribs are arranged to incline downwards and inwards from the front and back sides of the lower surface respectively till intersect.

9. The new-type dual-passage paper feeding safety structure for shredders according to claim 1, wherein two indicating press areas are arranged respectively on the middle parts of the front and back sides of the upper surface of the dual-passage paper feeding safety cover plate.

10. The new-type dual-passage paper feeding safety structure for shredders according to claim 1, wherein the cross-section of the paper inlet is semi-circular, and the touch components are touch cams.

11. The new-type dual-passage paper feeding safety structure for shredders according to claim 1, wherein the new-type dual-passage paper feeding safety structure for shredders further comprises a paper thickness detecting device arranged in the paper inlet.

12. The new-type dual-passage paper feeding safety structure for shredders according to claim 1, wherein the dual-passage paper feeding safety cover plate further has a disc feeding passage at its middle part and above the paper shredding blade shafts.

13. The new-type dual-passage paper feeding safety structure for shredders according to claim 1, wherein the shredder upper lid further has a card feeding passage, the shredder further comprises a set of card shredding blade shafts, and the card feeding passage is located above the card shredding blade shafts.

* * * * *